US005859952A

United States Patent [19]

Levine et al.

[11] Patent Number: 5,859,952

[45] **Date of Patent: *Jan. 12, 1999**

[54] HUMIDIFIER WITH UV ANTI-CONTAMINATION PROVISION

[75] Inventors: Lawrence Levine, Fairfield, Conn.; Leo Gross, New York; Paul Siller, East Moriches, both of N.Y.

[73] Assignee: Slant/Fin Corporation, Greenvale, N.Y.

[ * ] Notice: The term of this patent shall not extend beyond the expiration date of Pat. No. 5,677,982.

[21] Appl. No.: 839,169

[22] Filed: Apr. 23, 1997

Related U.S. Application Data

[63] Continuation-in-part of Ser. No. 553,057, Nov. 3, 1995, Pat. No. 5,677,982.

[51] Int. Cl.[6] ..... A61H 33/12; B05B 1/08

[52] U.S. Cl. ..... 392/405; 261/DIG. 48; 239/102.1

[58] Field of Search ..... 392/390, 391, 392/393, 401–406; 261/139, 142, 94, 99, DIG. 48, DIG. 55, DIG. 65; 239/44, 45, 102.1, 102.2, 135, 136; 128/203.2

[56] References Cited

U.S. PATENT DOCUMENTS

| | | | |
|---|---|---|---|
| 3,729,138 | 4/1973 | Tysk | 239/102.2 |
| 3,867,485 | 2/1975 | Yeagle | 261/94 |
| 4,089,915 | 5/1978 | Jackson | 392/405 |
| 4,429,735 | 2/1984 | Nomaguchi et al. | 165/60 |
| 4,465,234 | 8/1984 | Maehara et al. | 239/102.2 |
| 4,630,475 | 12/1986 | Mizoguchi | 261/1 |
| 5,677,982 | 10/1997 | Levine | 392/405 |

*Primary Examiner*—Teresa J. Walberg
*Assistant Examiner*—Sam Paik
*Attorney, Agent, or Firm*—Herbert Dubno

[57] ABSTRACT

A humidifier, especially for room humidification, has a reservoir for water to be dispersed into the atmosphere, a unit for dispersing the water and a passage between the reservoir and that unit which is provided with a UV radiation generator for sterilizing water before it reaches the unit. The unit can be a heater, an ultrasonic atomizer for the water or a wettable surface over which air is passed.

7 Claims, 6 Drawing Sheets

FIG. 9
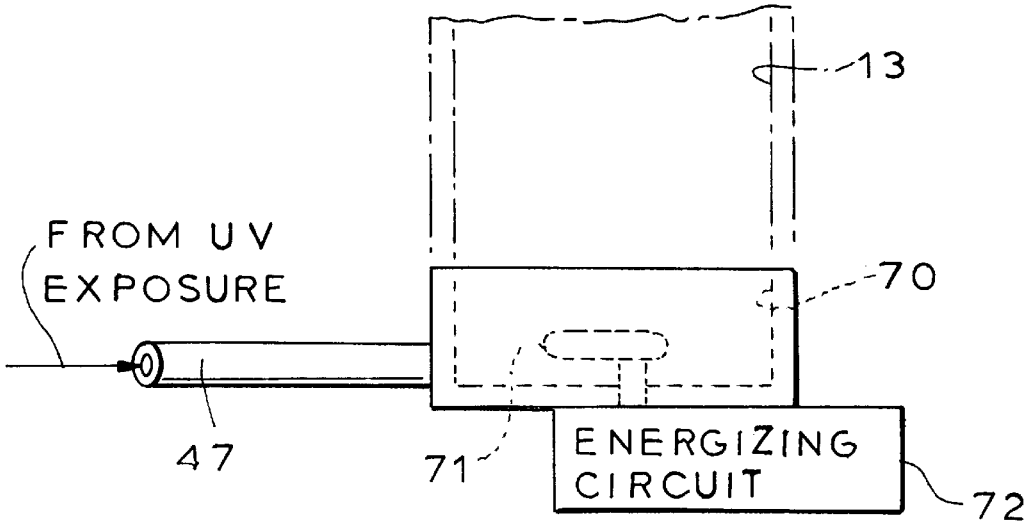
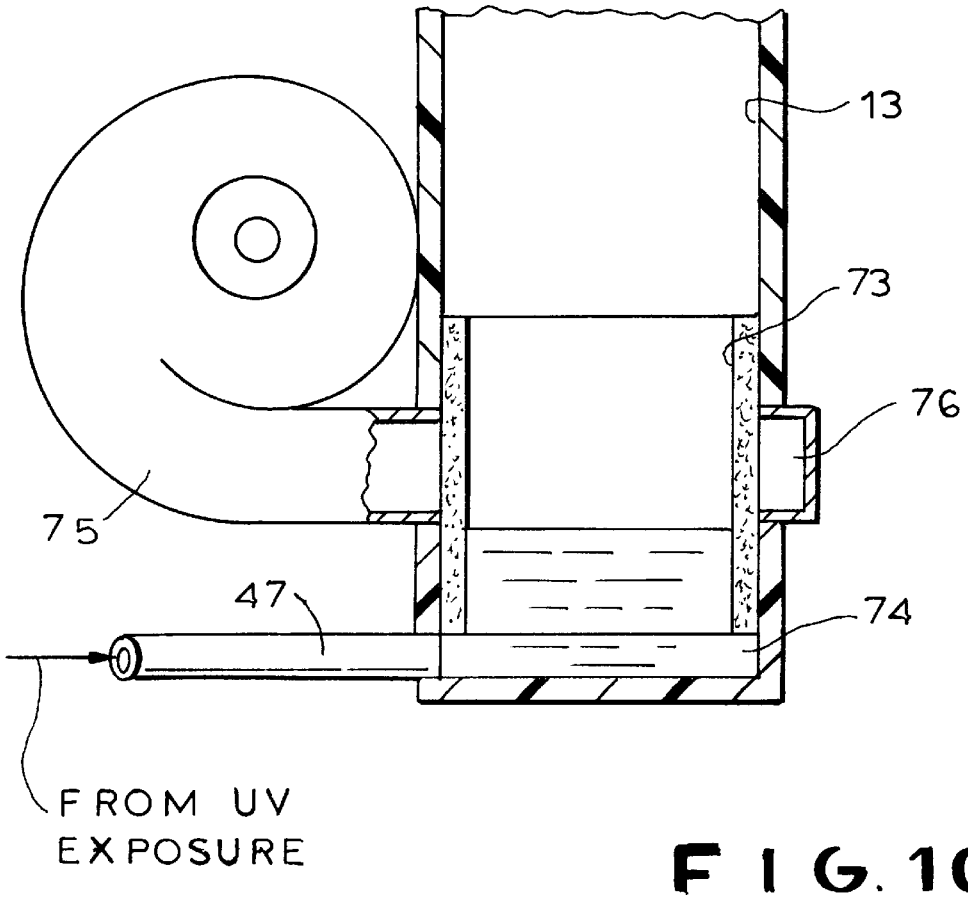
FIG. 10

HUMIDIFIER WITH UV ANTI-CONTAMINATION PROVISION

CROSS REFERENCE TO RELATED APPLICATION

This application is a continuation-in-part of our application Ser. No. 08/553,057 filed 3 Nov. 1995, now U.S. Pat. No. 5,677,982.

FIELD OF THE INVENTION

Our present invention relates to humidifiers and, more particularly, to room humidifiers of the type in which water from a reservoir which can be removably mounted on a base, is vaporized in the humidifier so that water vapor is discharged into the atmosphere.

BACKGROUND OF THE INVENTION

Humidifiers are used in a wide variety of applications, including the humidification of gases for use in therapeutic environments or for home heating purposes, as space humidifiers and otherwise and among the humidifiers which may be mentioned are those described in United States Patents: U.S. Pat. Nos. 5,329,939, 5,195,515, 4,891,171, 4,714,078, 4,518,404, 4,500,480, 4,225,542, 4,177,945, 4,100,235, 4,089,915 and others. Among these are those which are self-sterilizing, i.e. reduce the contamination which otherwise tends to develop in a humidifier unit because of the presence of microorganisms in the water which is used or because water at a temperature suitable for the growth of microorganism cultures may stand in the unit.

OBJECTS OF THE INVENTION

It is the principal object of the present invention to provide an improved humidifier, especially a space humidifier for raising the humidity in a domestic environment, which has reduced tendency to discharge microorganisms into the atmosphere.

Another object of the invention is to provide an improved humidifier which operates sterilely as far as the release of water vapor into the environment is concerned.

Still another object of the invention is to provide a high efficiency compact humidifier which avoids drawbacks of earlier humidifiers and has a reduced tendency to promote microorganism growth.

SUMMARY OF THE INVENTION

We have discovered that these objects are attainable by incorporation into a humidifier of a germicidal lamp, especially a UV lamp which preferably is provided along a path of the water from a reservoir to a heater and, most advantageously, is disposed at a compartment for the water to be fed to the heater so that the water in this compartment can be exposed to the germicidal lamp for a period of time sufficient to sterilize the water in the compartment.

In other words the humidifier of the present invention combines the effects of an UV radiation generator, namely, a UV lamp, and of heat to minimize the viability of microorganisms in the water which is ultimately released as water vapor and thus reduces the harmful particulates that might otherwise be released into the air by conventional humidifiers. According to the invention, water is fed by gravity into the sterilization chamber, preferably by a self-closing valve at the bottom of the removable reservoir or water container. The container can be filled with water through a removable cover in the top or by inverting the container and filling it through the bottom through the self-closing valve. According to a feature of the invention, the water vapor is discharged from the top of the container via an outlet at the upper end of the duct extending from bottom to top in the container and communicating with a heating chamber in the base. The heating chamber is preferably constituted as a casting and communicates with a pipe which draws sterilized water from the UV compartment.

According to the invention, water can flow in a metered manner through a small hole in a partition from a cold water compartment communicating with the self-closing valve of the container into the sterilizing compartment where its residence time is sufficient to effect sterilization.

The floor of this compartment can be composed of a UV transparent window allowing substantially all of the output of a UV lamp mounted below this compartment to pass through into the water in the sterilization compartment. A metered flow of a water can then pass into a third compartment which communicates with the aforementioned pipe.

According to a feature of the invention a thermostat on the casting deenergizes the heating element when the temperature of the latter reaches a threshold signalling the known supply of water. This thermostat can have a manual reset.

A fan in the base of the apparatus serves to prevent overheating of the lamp ballast and the lamp and, in addition, can induce a flow of the steam powered and out of the apparatus. The apparatus can have a humidistat which can put on the heater when the room humidity falls below a preset level and can turn off the heater when the humidity level in the room is restored.

The humidifier of the invention can thus comprise:

a housing;

a water reservoir removably mounted on the housing and provided with means for supplying water to the housing;

a heater in the housing communicating with the water reservoir for vaporizing water to produce water vapor;

means on the housing for discharging the water vapor into the atmosphere; and an ultraviolet radiation generator in the housing for irradiating water in the housing with ultraviolet to limit microorganism discharge with water vapor into the atmosphere.

The invention as described, having the ultraviolet radiation generator in a compartment connected between the reservoir and the unit for dispersing the water into the air, need not use a heater for vaporizing the water but can utilize some other means capable of increasing the humidity of the air, e.g. a wick or other high surface area evaporator through which air can be passed, or even an ultrasonic atomizer which disperses the moisture into the air in a finely-divided form.

BRIEF DESCRIPTION OF THE DRAWING

The above and other objects, features, and advantages will become more readily apparent from the following description, reference being made to the accompanying drawing in which:

FIG. 9 is a diagrammatic elevational view showing another embodiment of the invention for dispersing the water into air which is emitted by the humidifier downstream of the ultraviolet radiation source; and FIG. 10 is a cross sectional view of still another embodiment of a unit downstream of the UV source for introducing sterilized water into the air.

SPECIFIC DESCRIPTION

As has been described previously, the humidifier of the invention is distinguished in that it provides for UV sterilization of the water which is to be evaporated for producing the water vapor.

Figure 1:
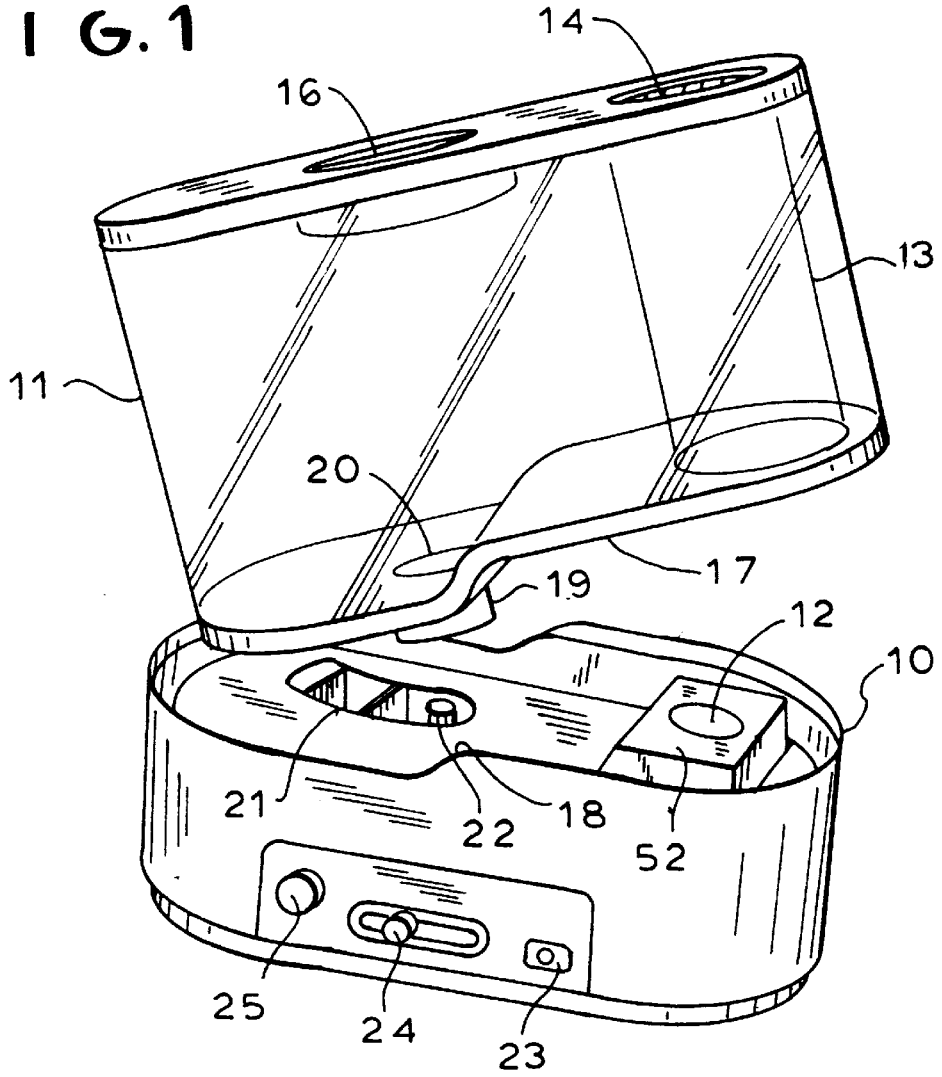
FIG. 1 is a diagrammatic perspective view of the humidifier according to the invention, shown with the water reservoir partly removed.
Figure 2:
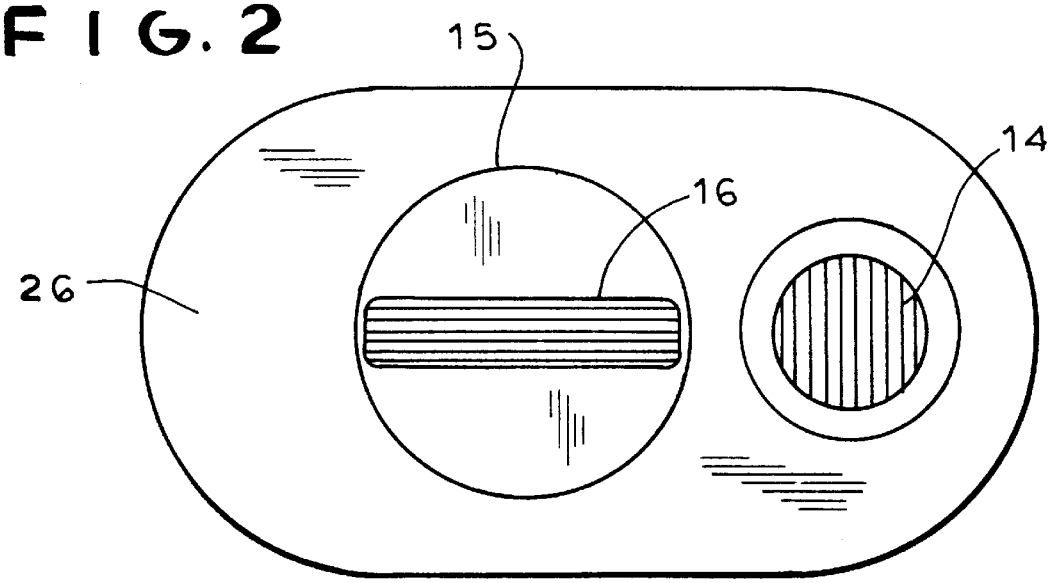
FIG. 2 is a top view of the humidifier showing the handle and the vent for discharging the water vapor.
Figure 4:
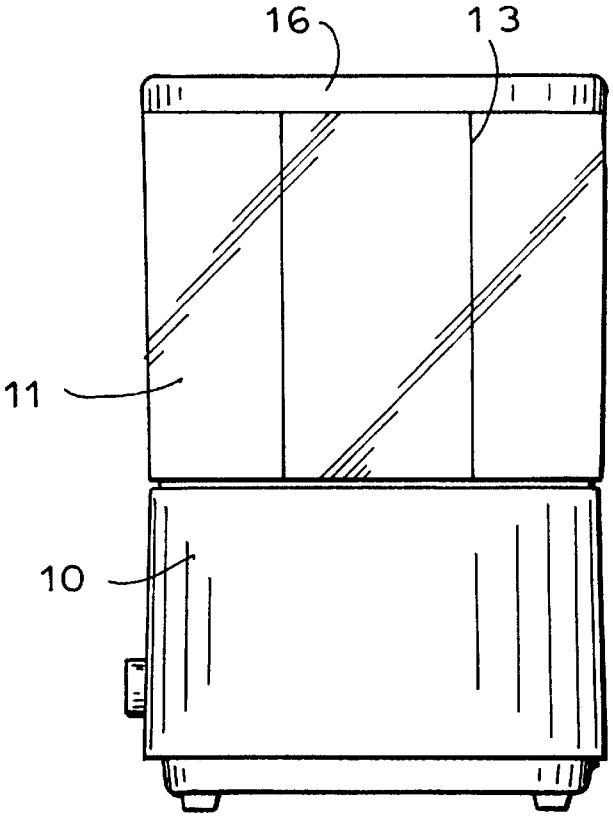
FIG. 4 is an end view.

To this end, the humidifier, as can be seen from FIG. 1, comprises a base 10 and water reservoir 11 which fits onto the base 10. The base 10 is provided with an opening 12 registering with a tubular duct 13 within the reservoir 11 terminating in a vent 14 (FIG. 2) provided with louvers or the like from which the water vapor is discharged. The vent 14 can be rotated to direct the flow of water vapor from the humidifier.

The reservoir 11 further comprises a cover 15 with a handle 16 which can be gripped by the user to carry the reservoir to a location for filling, e.g. a water tap. The cover can be removed by rotating it, thereby unblocking a filling opening in the opaque top 26 of the otherwise transparent reservoir 11. Alternatively the reservoir or container 11 can be inverted and filled through a self-closing valve.

The bottom 17 of the reservoir 11 is stepped to fit into the stepped top 18 of the base.

A spigot 19 is formed with a self-closing valve 20 to control the passage of water from the reservoir 11 and through which the container 11 can be filled. The water flows through the valve 20 to a chamber in the base via an inlet 21 of the latter. A post 22 is visible in this inlet and serves to operate the valve 20. The valve 20 is of the self-closing type and prevents escape of water from the reservoir 11 during the filling thereof and until the filled reservoir is returned to the base 10. The base 10 has an on-off switch 23 and a humidity control 24 which operate in a manner to be described subsequently. The humidistat itself is represented at 25 in FIG. 1.

Figure 7:
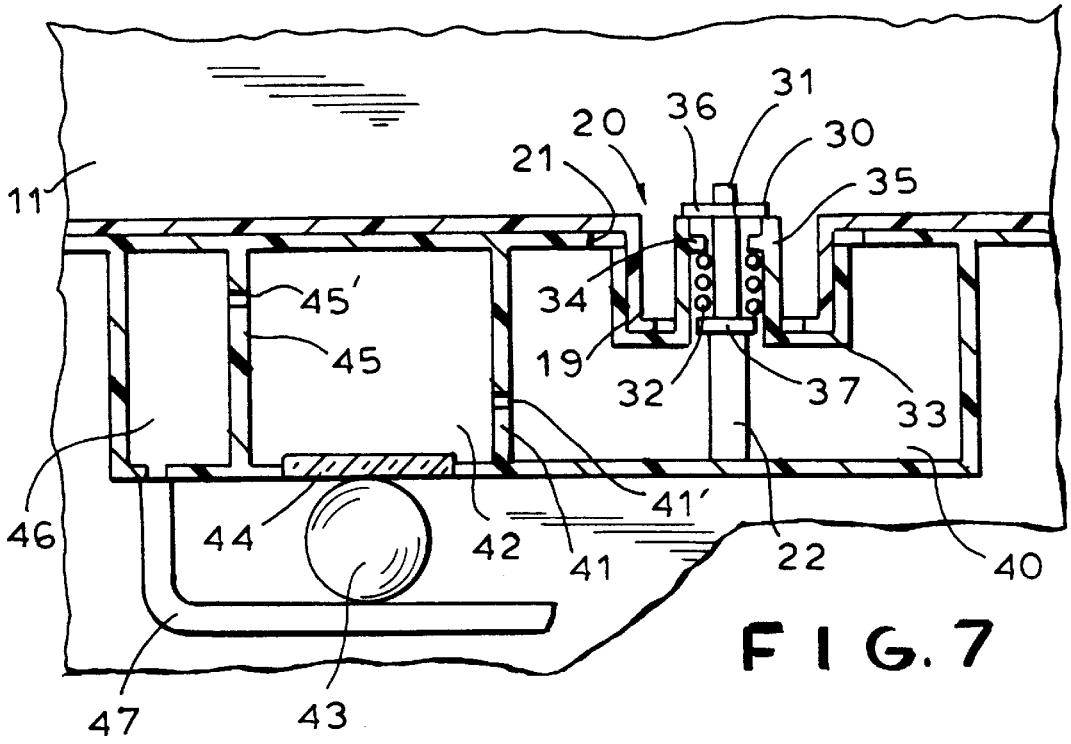
FIG. 7 is a cross sectional view taken along the line VII—VII of FIG. 6.

As can be seen from FIG. 7, the valve 20 of the reservoir 11 can comprise a frustoconical valve member 30 whose stem 31 is biased downwardly by a coil spring 32 in the spigot 19 which is closed by a cap 33 forming a shoulder 34 against which the spring 32 is seated. The cap 33 also has a tubular boss 35 forming a seat 36 engageable by valve member 30 when the spring is fully expanded to block escape of the water from the reservoir 11.

The stem 31 has a plate 37 which can engage the post 22 in a cold water chamber 40 of the base 10 which can be centered in the opening 21 receiving the spigot and mentioned previously.

When the stem 31 is lifted and the valve member 30 removed from its seat 36, water can pass through passages in the shoulder 34 into the chamber 40.

When, however, the reservoir 11 is lifted from the base, the spring 32 brings the valve member 30 into sealing engagement with the valve seat 36 to prevent escape of water from the reservoir.

As is also apparent from FIG. 7, the water in the chamber 40 can pass in a metered flow through an aperture 41' in the partition 41 into a sterilizing chamber 42 in which the water is exposed to rays from an ultraviolet lamp 43 through the ultraviolet transparent window 44 before passing through an aperture 45' in a further partition 45 into a compartment 46 from which the UV sterilized water is delivered by a pipe 47 and by gravity to a heating chamber. The partitions 41 and 45 and their apertures guarantee a sufficient residence time for the water in the compartment 42 to ensure UV sterilization.

Figure 5:
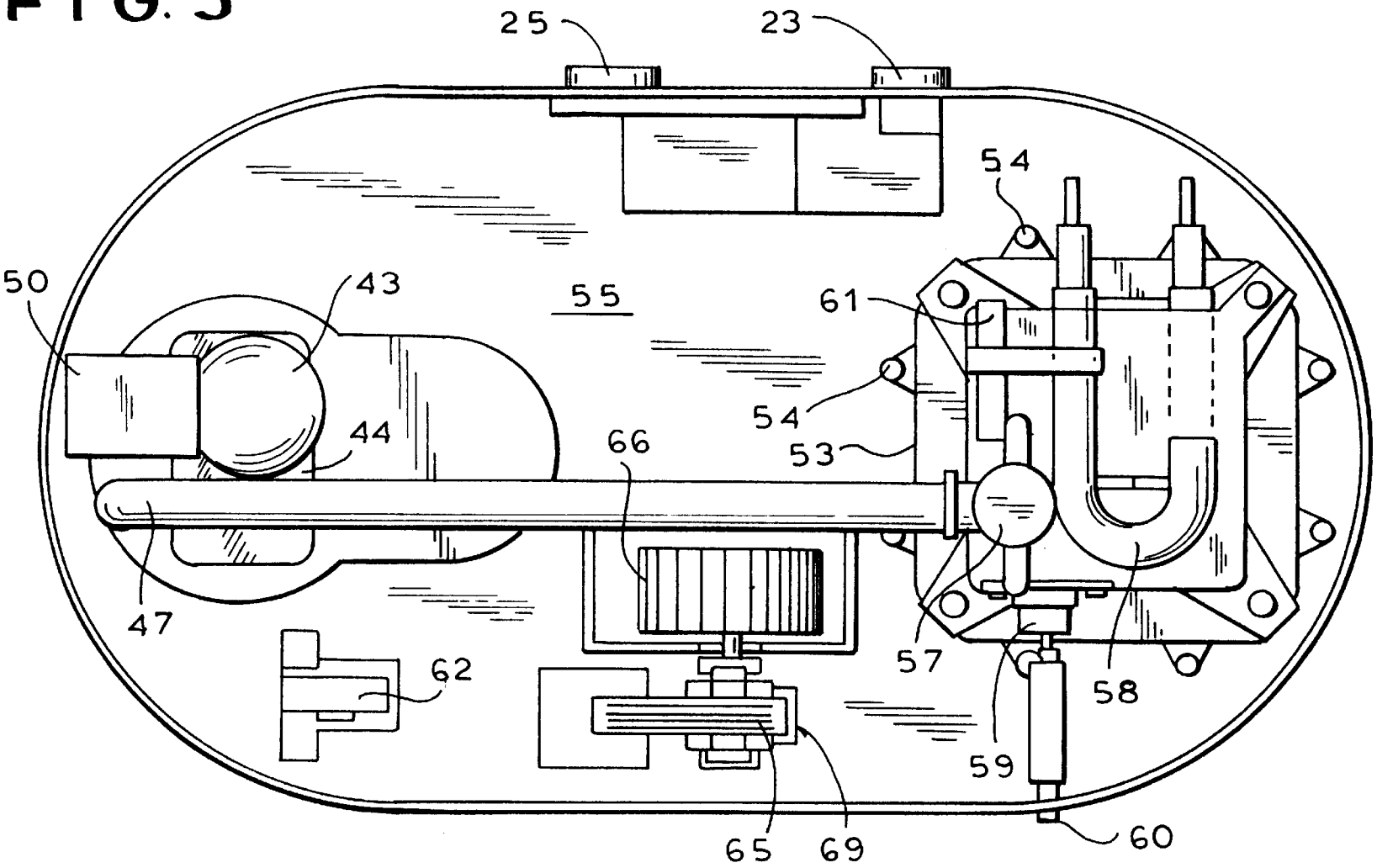
FIG. 5 is a bottom view of the base with the lower cover removed showing the sterilizing and vaporizing system.
Figure 6:
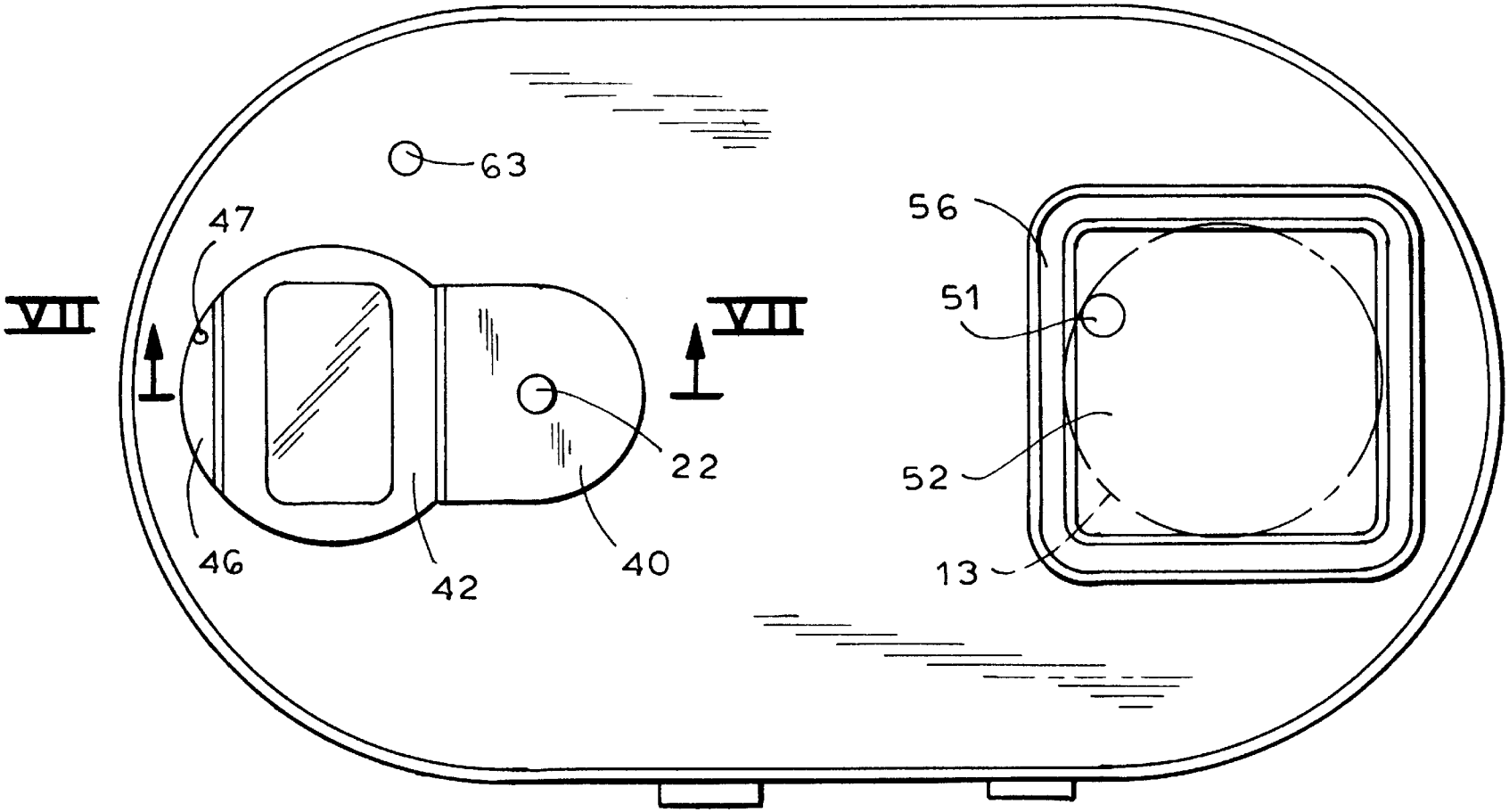
FIG. 6 is a top view of the base without the cover for the heating chamber and showing the sterilizing chamber from above.

Turning to FIG. 5 it can be seen that the UV lamp 43 is located below the UV transparent window 44 and is received in a socket 50 also located below the chambers 40, 42, 46. The pipe 47 carrying the sterilized water communicates at 51 with a chamber 52 (FIG. 6) formed in a casting 53 shown to be mounted by screws 54 to the plate 55 above which the chambers 40, 42, 46 are located. The cover for the chamber 52 is not visible and has been removed, but seals the chamber 52 via an elastic seal received in a groove 56. That cover may have a steam outlet communicating with the duct 13 represented in dot-dash lines in FIG. 6.

Within the casting 53 there is provided a drain cap 57 which, when removed, can allow the chamber 52 to be drained. The casting also holds the resistance heater 58 and the ballast (not otherwise visible) for the UV lamp. On the casting 53, there is further provided a thermostat 59 which trips should there be overheating of the casting in the absence of water, that thermostat being resettable by a plunger 60. A fuse 61 is likewise provided for the system.

On the plate 55 there is mounted a safety switch 62 actuated by a pin 63 when the reservoir 11 is in place to allow the circuitry to operate and designed, when the reservoir 11 is lifted off the base, to deenergize the heater and the ballast.

Also mounted on the plate 55 is a fan 64 comprising a motor 65 and an axial intake radial outflow fan wheel 66 driven by this motor, to cool the ballast, the UV lamp and the casting 53.

Figure 8:
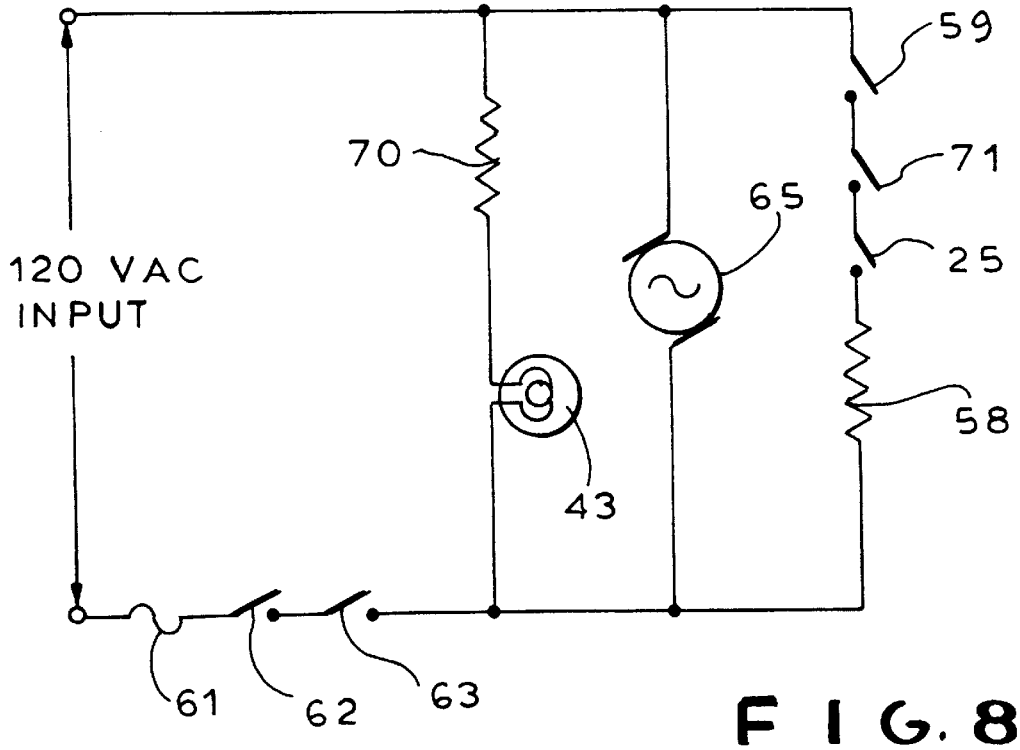
FIG. 8 is a circuit diagram relating to the humidifier.

Turning to FIG. 8 it can be seen that the fuse 61 and the safety switch 62 are connected in series with the on-off switch 23 and the fan motor 65 and also in series with the UV lamp 43 and the ballast 70. The thermostat 59 together with an automatic reset thermostat 71 and the humidistat 25 lie in series with the main heater 58.

Figure 3:
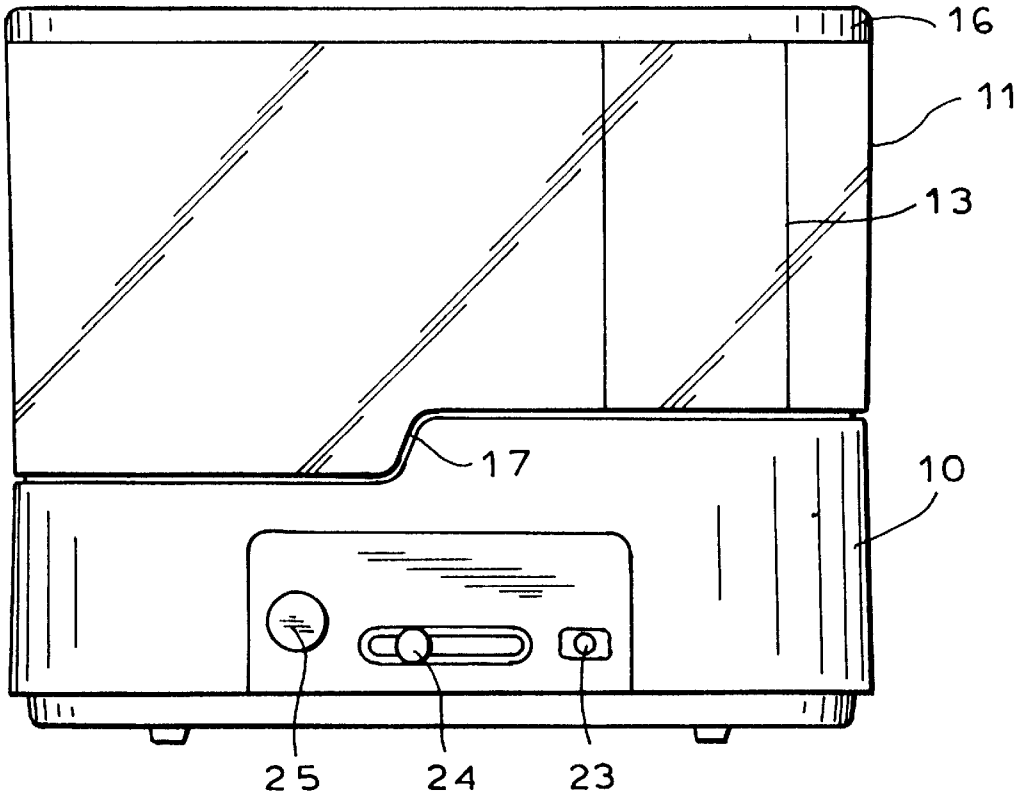
FIG. 3 is a side elevational view of the humidifier with the water reservoir in place.

In operation, assuming that the filled reservoir 11 is in place on the base 10 (FIG. 3), the valve 20 is open and water fills the compartments 40 and 42. When the on-off switch 23 is actuated (switch 62 is closed by the reservoir 11 and switches 59 and 71 are closed because the block 53 is unheated, the UV lamp 43 and fan motor 65 are actuated and UV sterilization of the water in compartment 42 is ensured.

When the humidistat 25 senses insufficient humidity in the room, the switch thereof closes and the heater 58 is energized to cause the water in the chamber 52 to boil and steam to be emitted through the duct 13 and the louvers 14 into the room. This operation continues with water passing by gravity through the pipe 47 to the heating chamber and being sterilized in the compartment 42 until the reservoir 11 is drained or the humidistat discontinues operation. Should the water drain out and the block 53 heat above the threshold of the thermostat, the latter opens. The reservoir can be refilled and the operation repeated.

The housing can be provided with a window having a lens capable of filtering out UV light and through which illumination of the UV lamp can be detected for indicating to the user that the UV lamp is functioning. Means can also be provided for locking the duct 13 onto the base when the apparatus is in operation to minimize the possibility of scalding should the container be removed while steam is being generated or the unit is overturned.

The embodiments described are directed to a humidifier utilizing a heater for vaporizing the water which reaches the heating unit through the tube 47 after the water has been sterilized by ultraviolet from the lamp 43.

However, this principle is also applicable to other systems which may be used to humidify the air. For example, in FIG. 9 the tube 47 can deliver the water which has been sterilized in the sterilizing compartment 42 by the ultraviolet radiation from the lamp 43 to a chamber 70 containing an ultrasonic atomizer 71 electrically energized by a circuit 72 so that the water entering the chamber 70 is atomized into air rising through the tubular duct 13 for emission into the place to be humidified. A cool moist approach can also be used as has been indicated in FIG. 10, by way of example.

In this system the water is spread over an air-permeable structure, for example, a wick 73 which is capable of drawing the water upwardly from a chamber 74 to which the water is fed after sterilization via the tube 47. The bibulous wick 43 draws the water up by capillary action and air can be blown through this air-permeable high surface-area member by a blower 75 feeding an annular chamber 76 surrounding the wick so that air moisturized by the water on the wick passes upwardly through the duct 13 to be dispensed into the space to be humidified.

Apart from the fact that the moisture is delivered to the air ultrasonically in the case of FIG. 9 by atomization of the water and by evaporation of the air from a wetted surface in FIG. 10, the embodiments of FIGS. 9 and 10 can be constructed as has been described in connection with FIG. 7, for example, and operates in accordance with the principles described.

We claim:

1. A humidifier comprising:

a housing;

a water reservoir removably mounted on said housing and provided with means for supplying water to said housing;

means on said housing for discharging said water into air and thereby humidifying a space containing said humidifier;

means on said housing for discharging air in which water has been dispersed into the atmosphere; and an ultrasonic radiation generator in said housing for irradiating water in said housing with ultraviolet to limit microorganism discharge into the atmosphere, said ultraviolet radiation generator including an ultraviolet lamp on said housing disbursed between said reservoir and said means for discharging water into air and a compartment connected between said reservoir and said means for discharging water into air and traversed by water fed to said means for discharging water into air, said compartment having an ultraviolet transparent window, said lamp being juxtaposed with said window.

2. The humidifier defined in claim 1, further comprising a pipe connecting said compartment with said means for discharging water into air.

3. The humidifier defined in claim 1 wherein said means for discharging water into air includes an ultrasonic atomizer for atomizing water to disperse water into air.

4. The humidifier defined in claim 1 wherein said means for discharging water into air includes a wetted surface and means for displacing air over said wetted surface.

5. The humidifier defined in claim 4 wherein said wetted surface is porous and said means for discharging air includes a fan for blowing air through said surface.

6. The humidifier defined in claim 4 wherein said housing has a base and said reservoir is removably mounted on said base, said reservoir being provided with a self-closing valve opening automatically upon positioning of said reservoir on said base.

7. The humidifier defined in claim 6 wherein said reservoir is formed with a duct constituting said means on said housing for discharging air in which water has been dispersed into the atmosphere.

* * * * *

US005859952C1

(12) EX PARTE REEXAMINATION CERTIFICATE (10698th)

United States Patent
Levine et al.

(10) Number: US 5,859,952 C1
(45) Certificate Issued: Sep. 4, 2015

(54) HUMIDIFIER WITH UV ANTI-CONTAMINATION PROVISION

(75) Inventors: Lawrence Levine, Fairfield, CT (US); Leo Gross, New York, NY (US); Paul Siller, East Moriches, NY (US)

(73) Assignee: HELEN OF TROY LIMITED, Belleville, St. Michael (BB)

Reexamination Request:
No. 90/013,177, Apr. 1, 2014

Reexamination Certificate for:

| | |
|---|---|
| Patent No.: | **5,859,952** |
| Issued: | **Jan. 12, 1999** |
| Appl. No.: | **08/839,169** |
| Filed: | **Apr. 23, 1997** |

Related U.S. Application Data

(63) Continuation-in-part of application No. 08/553,057, filed on Nov. 3, 1995, now Pat. No. 5,677,982.

(51) Int. Cl.

| | |
|---|---|
| ***A61H 33/12*** | (2006.01) |
| ***B05B 1/08*** | (2006.01) |
| ***A61M 11/00*** | (2006.01) |
| ***A61M 15/00*** | (2006.01) |

(52) U.S. Cl.
CPC ..... *A61M 11/005* (2013.01); *A61M 15/0085* (2013.01)

(58) Field of Classification Search
None
See application file for complete search history.

(56) References Cited

To view the complete listing of prior art documents cited during the proceeding for Reexamination Control Number 90/013,177, please refer to the USPTO's public Patent Application Information Retrieval (PAIR) system under the Display References tab.

*Primary Examiner* — Glenn K Dawson

(57) ABSTRACT

A humidifier, especially for room humidification, has a reservoir for water to be dispersed into the atmosphere, a unit for dispersing the water and a passage between the reservoir and that unit which is provided with a UV radiation generator for sterilizing water before it reaches the unit. The unit can be a heater, an ultrasonic atomizer for the water or a wettable surface over which air is passed.

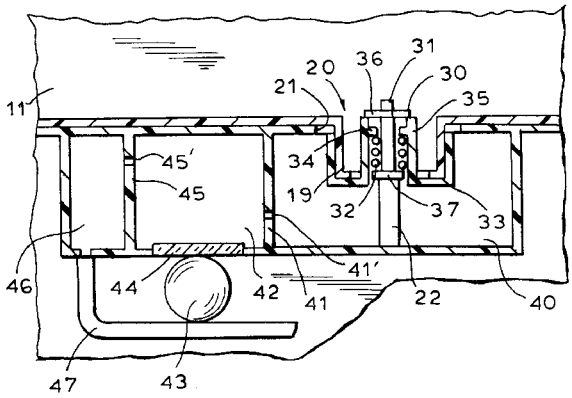

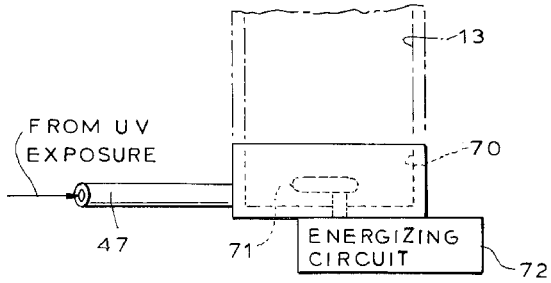

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claim 1 is determined to be patentable as amended.

Claims 3-7, dependent on an amended claim, are determined to be patentable.

1. A humidifier comprising:

a housing;

a water reservoir removably mounted on said housing and provided with means for supplying water to said housing;

means on said housing for discharging said water into air and thereby humidifying a space containing said humidifier;

means on said housing for discharging air in which water has been dispersed into the atmosphere; [and]

an ultrasonic radiation generator in said housing for irradiating water in said housing with ultraviolet to limit microorganism discharge into the atmosphere, said ultraviolet radiation generator including an ultraviolet lamp on said housing disbursed between said reservoir and said means for discharging water into air and a compartment connected between said reservoir and said means for discharging water into air and traversed by water fed to said means for discharging water into air, said compartment having an ultraviolet transparent window, said lamp being juxtaposed with said window*; and a pipe connecting said compartment with said means for discharging water into air*.

* * * * *